US005171512A

United States Patent [19]

Mende et al.

[11] Patent Number: 5,171,512

[45] Date of Patent: Dec. 15, 1992

[54] MELT-BLOWING METHOD HAVING NOTCHES ON THE CAPILLARY TIPS

[75] Inventors: Takayuki Mende; Takanobu Sakai, both of Yamaguchi, Japan

[73] Assignee: Mitsui Petrochemical Industries, Ltd., Tokyo, Japan

[21] Appl. No.: 666,064

[22] Filed: Mar. 7, 1991

Related U.S. Application Data

[62] Division of Ser. No. 327,252, Mar. 22, 1989, Pat. No. 5,017,112.

[30] Foreign Application Priority Data

Mar. 25, 1988 [JP] Japan ..... 63-73021
Mar. 28, 1988 [JP] Japan ..... 63-75420

[51] Int. Cl.[5] ..... D01D 5/11

[52] U.S. Cl. ..... 264/555; 264/177.13; 425/72.2; 425/464

[58] Field of Search ..... 264/177.1, 177.11, 177.12, 264/177.13, 177.14, 177.15, 177.16, 12, 13, 517, 518, 555; 156/167; 425/461, 462, 463, 464, 465, 131.5, 72.2

[56] References Cited

U.S. PATENT DOCUMENTS

| | | | |
|---|---|---|---|
| 2,508,462 | 5/1950 | Marshall | 264/12 |
| 2,660,132 | 11/1953 | Pyenson | 425/461 |
| 2,673,121 | 3/1954 | Brennan | 264/12 |
| 3,224,852 | 12/1965 | Stalejo | 65/16 |
| 3,259,479 | 7/1966 | Tiede | 264/12 |
| 3,649,232 | 3/1972 | Battigelli | 264/164 |
| 3,649,233 | 3/1972 | Battigelli | 264/164 |
| 3,687,592 | 8/1972 | Miyamoto et al. | 425/461 |
| 3,825,379 | 7/1974 | Lohkamp et al. | 425/464 |

(List continued on next page.)

FOREIGN PATENT DOCUMENTS

| | | | |
|---|---|---|---|
| 56-159336 | 12/1981 | Japan . | |
| 0678093 | 8/1979 | U.S.S.R. | 264/177.15 |

OTHER PUBLICATIONS

Loos & Springer, "Curing of Epoxy Matrix Composites", *J. of Composite Materials*, 17:135–169 (1983).

Hsiao & Kline, "The Measurement of Viscoelastic Moduli Using An Ultrasonic Spectroscopy Technique", 1984 Ultrasonics Symposium, pp. 443–446 (1984).

Kline, "Measurement of Attenuation and Dispersion Using An Ultrasonic Spectroscopy Technique", *J. Acoust. Soc. Am.*, 76(2):498–504 (1984).

Kline, Madaras, & Boltz, "Nondestructive Characterization of Elastic Anisotropy in Carbon-Composites", Nondestructive Evaluation: NDE Planning and Application. *A Symposium of the Am. Soc. of Mech Engr.*, pp. 135–140 (1989).

Springer, "Resin Flow During the Cure of Fiber Reinforced Composites", *J. Composite Materials*, 16:400–410 (1982).

Lee, Loos & Springer, "Heat of Reaction, Degree of Cure, and Viscosity of Hercules 3501-6 Resin", *J. Composite Materials*, 16:510–520 (1982).

Gutowski, "A Resin Flow/Fiber Deformatin Model for Composites", SAMPE Quarterly, 16(4):58–64 (1985).

(List continued on next page.)

*Primary Examiner*—Jill L. Heitbrink

*Attorney, Agent, or Firm*—Birch, Stewart, Kolasch & Birch

[57] ABSTRACT

A melt-blowing method having notches formed in the tip portions of capillaries of a melt-blowing die. This allows, during spinning, a high-speed gas blowing from orifices of the die to flow through the notches whereby the flow of a molten resin being extruded through each capillary is divided into two parts or more. This prevents fibers from becoming entangled or ball-shaped.

4 Claims, 4 Drawing Sheets

U.S. PATENT DOCUMENTS

| | | | |
|---|---|---|---|
| 3,954,361 | 5/1976 | Page | 425/464 |
| 4,116,656 | 9/1978 | Mukai et al. | 264/12 |
| 4,221,736 | 7/1980 | Bradt | 425/7 |
| 4,295,809 | 10/1981 | Mikami et al. | 264/12 |
| 4,380,570 | 4/1983 | Schwarz | 428/296 |
| 4,455,268 | 6/1984 | Hinrichs | 264/23 |
| 4,515,545 | 5/1985 | Hinrichs | 425/143 |
| 4,536,361 | 8/1985 | Torobin | 264/147 |
| 4,559,810 | 12/1985 | Hinrichs | 73/54 |
| 5,031,457 | 7/1991 | Kline | 73/597 |

OTHER PUBLICATIONS

Dave, Kardos, & Dudukovic, "A Model For Resin Flow During Composite Processing: Part 1-General Mathematical Development", *Polymer Composites*, 8(1):29-38 (1987).

Dave, Kardos, & Dudukovic, "A Model For Resin Flow During Composite Processing Part 2: Numerical Analysis for Unidirectional Graphite/Epoxy Laminates", *Polymer Composites*, 8(2)123-132 (1987).

Kline & Chen, "Ultrasonic Technique for Global Anisotropic Property Measurement in Composite Materials", *Materials Evaluation*—46, pp. 986-992 (1988).

Kline, "Wave Propagation in Fiber Reinforced Composites for Oblique Incidence", *J. of Composite Materials*, 22: pp. 287-302, (Mar. 1988).

Kline & Kulathu, "On-Line Monitoring of Composite Prepreg Fabrication", Presented at the Winter Annual Meeting of the Am. Soc. of Mech. Engr., Atlanta, Ga. (Dec. 1991).

Kline, "Ultrasonic Characterization of Composite Microstructure", Unpublished.

MELT-BLOWING METHOD HAVING NOTCHES ON THE CAPILLARY TIPS

This application is a divisional of copending application Ser. No. 07/327,252 filed on Mar. 22, 1989, now U.S. Pat. No. 5,017,112.

BACKGROUND OF THE INVENTION

The present invention relates to a spinning method employing a melt-blowing method in which a thermoplastic resin is extruded through capillaries while in its molten state, and is simultaneously drawn into a fibrous form by the use of a high-speed gas discharged from orifices provided in the periphery of the capillaries. The present invention also relates to a melt-blowing die suitable for use in the spinning method.

Related Art:

Various methods of manufacturing a fiber web are known that employ a melt-blowing method and a melt-blowing die combined with capillaries. FIG. 10 shows an example of a method of this type. A thermoplastic resin is kneaded by an extruder 2 while the resin is in its molten state, and the resin is then extruded through capillaries 3 of a melt-blowing die 1. While the resin is extruded, it is drawn into a fibrous form by the use of a high-speed gas discharged from orifices formed in the periphery of the capillaries 3. The resin is then collected by a collecting device 5 on which the resin falls in the form of a web. There are various types of melt-blowing dies, as disclosed in U.S. Pat. No. 3,825,379. One type of melt-blowing die has capillaries horizontally arranged in the tip portion of a die having a triangular section and soldered to the tip portion, and also has gas plates provided in such a manner as to define a suitable clearance in cooperation with the upper and lower sides of the tip portion of the die. Another type of melt-blowing die has horizontally arranged capillaries one of whose respective ends is firmly supported by a die block and is thus cantilevered, and also has gas plates provided on the upper and lower sides of the capillaries in such a manner that the tip portions of the gas plates oppose the free ends of the capillaries, with a suitable clearance defined therebetween. The clearance, which is defined between the gas plates, on one hand, and the tip portion of the die or the free ends of the capillaries, on the other, forms orifices. A gas from the orifices is blown at a predetermined angle onto the molten-state resin being extruded through the capillaries, thereby allowing the resin to be drawn into a fibrous form. Japanese Patent Laid-Open No. 159336/1981 (U.S. Pat. No. 4,380,570) discloses an arrangement in which capillaries disposed on the nozzle plate in a grating-like manner are each inserted through net-shaped hole portions of a screen, with their tip portions projecting, and in which orifices are formed in the periphery of those portions of the capillaries inserted through the net-shaped holes. In this arrangement, a gas blowing from the orifices allows a resin extruded through the capillaries to be drawn into a fibrous form. Melt-blowing dies in which the above-described capillaries are used have various advantages. For instance, when the dies are compared with the conventional type in which a multiplicity of fine holes are formed in the die block, it is possible to avoid electric discharge machining which has been effected to form fine holes, and it is possible to accurately arrange the capillaries, thereby making it easy for the fine holes to be arranged in a line. This allows a reduction in the cost incurred in the production of the dies. In addition, by virtue of the arrangement in which the tip portions of the capillaries project outwardly from the dies, it is possible to monitor the condition of the tips of the capillaries during operation. This enables an abnormality to be found at an early stage.

In a melt-blowing method, if the diameter of the fine holes is increased, this in general leads to the effect that clogging is eliminated and maintenance is facilitated, while the discharge amount of the molten resin per unit fine hole is increased whereby the productivity is enhanced. However, the molten resin discharge amount and the diameter of the fiber formed are in a certain interrelationship in which, if the flow rate of a high-speed gas is constant, the fiber diameter increases as the discharge amount increases. Therefore, the productivity can be enhanced to only a limited extent if the fiber diameter is kept unchanged.

The present inventors have conducted various experiments with a view to increasing the productivity of the capillaries. As a result, they have found that, if notches are formed in the tips of the capillaries, the flow of the molten resin is divided at the notch portions, thereby enabling the formation of two or more fibers by a single capillary.

The present inventors have also found that, if projections formed by the notches of adjacent capillary are disposed in back-to-back contact with each other, there is a risk that fibers in their molten state may be entangled. In such cases, the fibers may become like a thick rope (hereinafter called "a rope"), or they may not become fibrous but, instead, become like a ball (hereinafter called "a shot").

In relation to the formation of notches in the tip portions of the capillaries, U.S. Pat. No. 3,825,379 also teaches capillaries obtained by machining the die block and the capillaries in such a manner as to form a triangular section of the tip portion of the die and form the tips of the capillaries into a triangular configuration in which tapered notches are formed above and below. The capillaries are arranged in such a manner that the projections formed by the tapered notches are directed horizontally. Projections of adjacent capillaries are disposed in back-to-back contact. With this arrangement, therefore, it is impossible to avoid the formation of ropes and shots.

Art related to the present invention includes, in addition to the above-described art, U.S. Pat. No. 4,826,415 previously filed by the present inventors.

SUMMARY OF THE INVENTION

The present invention has been made based on the above-stated findings. It is an object of the present invention to provide a spinning method employing a melt-blowing method, and a melt-blowing die, which feature notches formed in the tips of the capillaries and allow the flow of the molten resin to be divided, and which are thus capable of achieving a higher discharge amount of the molten resin than that obtainable with no notches, while involving no increase in the fiber diameter, and are also capable of avoiding the formation of ropes and shots.

According to one aspect of the present invention, there is provided a spinning method employing a melt-blowing method in which a thermoplastic resin is extruded through capillaries while the resin is in its molten state, and the resin is simultaneously drawn into a fibrous form by the use of a high speed gas blowing from orifices provided in the periphery of the capillaries. The spinning method comprises: the step of preparing notches formed in the tip portions of the capillaries, so that, during spinning, the high-speed gas blowing from the orifices is allowed to flow through the notches whereby the flow of the molten resin being extruded through each of the capillaries is divided into two parts or more.

According to another aspect of the present invention, there is provided a melt-blowing die which is suitable for use in the spinning method. The die has a plurality of capillaries arranged in a series, and orifices provided in the periphery of the outlets of the capillaries, the melt-blowing die being adapted to extrude a thermoplastic resin through the capillaries while the resin is in its molten state, and to simultaneously draw the resin into a fibrous form by the use of a high-speed gas blowing from the orifices. The melt-blowing die comprises notches formed in the tip portions of the capillaries so that the flow of the molten resin being extruded through each of the capillaries is divided into two parts or more.

DESCRIPTION OF THE PREFERRED EMBODIMENTS

Figure 1:
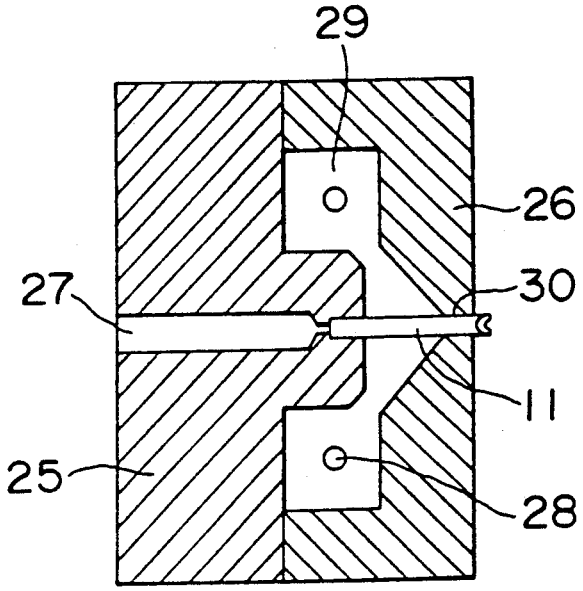
FIG. 1 is a sectional view of a melt-blowing die in accordance with the present invention.

One of the greatest feature of the spinning method of the present invention is, in a spinning method employing the so-called melt-blowing method, notches are formed in the tip portions of capillaries of a melt-blowing die. This allows, during spinning, a high-speed gas blowing from orifices of the die to flow through the notches whereby the flow of a molten resin being extruded through each of the capillaries is divided into two parts or more.

The melt-blowing die of the present invention that is used to carry out the method of the present invention has a plurality of capillaries arranged in a series, and orifices provided in the periphery of the outlets of the capillaries. The melt-blowing die is adapted to extrude a thermoplastic resin through the capillaries while the resin is in its molten state, and to simultaneously draw the resin into a fibrous form by the use of a high-speed gas blowing from the orifices. The melt-blowing die is provided with notches formed in the tip portions of the capillaries so that the flow of the molten resin being extruded through each of the capillaries is divided into two parts or more.

The "capillaries" specified here are pipes which normally have an outer diameter of 0.2 to 3 mm and an inner diameter of 0.1 to 2 mm. Suitable internal and external configurations are not limited to circular ones, but they also include polygonal configurations, such as triangular and quadrangular ones. The tips of the capillaries should preferably project from the tip of the die block or the gas plates by a suitable amount. By virtue of this arrangement, the monitoring of the tips of the capillaries is facilitated, thereby enabling an abnormality to be found at an early stage.

The orifices may be the same as any of the conventional types, such as those disclosed in U.S. Pat. Nos. 3,825,379 and 4,380,570. That is, the orifices may be any of: those formed between the tip portion of a die that has a triangular section and that is provided with capillaries horizontally arranged therein, on one hand, and gas plates provided on the upper and lower sides of the tip portion of the die, on the other; those formed between the free ends of capillaries having one of their respective sides supported and cantilevered by a die block, on one hand, and the tip portions of gas plates provided on the upper and lower sides of the capillaries with a suitable clearance defined therebetween, on the other; and those formed in the periphery of capillaries partially inserted through net-shaped holes of a screen. However, the orifices should preferably be formed by holding the free end portions of the capillaries between flat surfaces of lip portions of the gas plates, thereby defining the orifices between the flat holding surfaces of the lip portions and the capillaries.

If orifices are formed between the tip portion of a die having a triangular section and gas plates, this arrangement is disadvantageous in that the gas plates and the tip portion of the die must be machined with a strict precision in order to attain an even clearance. In addition, although the clearance would remain constant until shortly after the assembly, there is a risk that the clearance may become inaccurate by such post-assembly factors as thermal strain and strains encountered while time passes. If the capillaries are supported in such a manner as to be cantilevered, the free ends of the capillaries tend to become irregular. In addition, there is a risk that the capillaries may vibrate when a high-speed gas is discharged. If the ends of the capillaries are inserted through the net-shaped holes of a screen, this arrangement is disadvantageous in that it is not easy to evenly form the net-shaped hole portions of the screen. In addition, a great amount of labor is required to insert a multiplicity of capillaries into the net-shaped hole portions one by one at small pitches. In contrast with these arrangements, if the capillaries are held between the flat holding surfaces of the lip portions, a melt-blowing die having an even clearance can be attained easily and positively. In addition, even when such factors as machining errors, thermal strain, or time-passage strains have more or less brought the holding surfaces into a condition in which they are not flat, it is possible to maintain the orifices substantially even, so far as the holding surfaces remain in contact with the capillaries. Further, since the other ends of the capillaries are firmly supported, it is possible to eliminate any vibration of the capillaries during the discharge of a gas, or any irregularities of the outlets of the capillaries. In addition, it is possible to reduce the flow of gas that does not contribute to drawing, thereby enabling an increase in the drawing efficiency with respect to the gas.

In order to allow the introduction of gas discharged from the above-described orifices in such a manner that the flow of the molten resin flowing through each of the capillaries is divided into two parts or more, notches are formed in the tip portion of each capillary.

Examples of the notches will be illustrated hereunder.

(1) As shown in FIG. 4A, and FIGS. 5A through 7B, the notches may be formed by cutting two sides of the tip portion of each of the capillaries into tapers so that the tip portion of the capillary is generally V-shaped, with two projections being formed at the tip of the capillary.

With these notches, the flow of the molten resin being discharged through the capillary is divided by a high-speed gas being introduced through the notches (taper-cut portions), and is also guided by the projections, so that the resin flows from the tips of the projections in a stringing manner.

(2) As shown in FIGS. 4B to 4G, the notches may be formed from the tip of each of the capillaries in the axial direction thereof.

Although a single axial notch may be formed, a plurality of notches may preferably be formed at constant or varied intervals in the circumferential direction of the capillary. FIGS. 4A to 4G show examples in which a plurality of notches are formed at constant intervals. Specifically, in the example shown in FIG. 4A, certain parts of the free end portion of a capillary 11 are cut into tapers, thus providing a v-shaped overall configuration in which projections 12 are formed on either side of a parabolic recess 13. In the example shown in FIG. 4B, a pair of U-shaped notch grooves 13' are formed in the free end portion of a capillary 11; in the example shown in Fig 4C, a pair of v-shaped notch grooves 14 are formed; in the example shown in FIG. 4D, four V-shaped grooves 15 are formed; and in the example shown in FIG. 4E, eight U-shaped notch grooves 16 are formed. In the example shown in Fig 4F, a pair of U-shaped notch grooves 17 are formed in a cone-shaped tip; and in the example shown in FIG. 4G, a V-shaped notch groove 19 is formed at each of the corners of a capillary 18 having a rectangular configuration.

In any of the illustrated examples, the notches are formed at equal intervals in the circumferential direction and in such a manner as to provide a symmetrical structure. However, the notches may be formed at unequal intervals.

If the notches are equally arranged, fibers forming the divided parts of the flow have like thicknesses. If the notches are unequally arranged, the fibers have unlike thicknesses, resulting in a fiber web having a different texture.

Examples of materials which may be used as the thermoplastic resin in the the present invention include: polyesters containing, e.g., polyamide, polyacrylonitrile, ethylene glycol, and terephthalic acid, as the component monomers; a linear polyester such as the ester of 1, 4-butanediol and dimethyl-terephthalic acid or terephthalic acid; a third category including polyvinylidene chloride, polyvinyl butyral, polyvinyl acetate, polystyrene, linear polyurethane resin, polypropylene, polyethylene polystyrene, polymethylpentene, polycarbonate, and polyisobutylene, and further including thermoplastic cellulose derivatives such as cellulose acetate, cellulose propionate, cellulose acetate-butyrate, and cellulose butyrate. In some cases, a die, an additive or a modifier may be added to the above-mentioned materials.

In order to ensure that the flow of the molten resin continuously occurs, the discharge rate of the resin must be maintained at least at a certain value. Also, if the amount of molten resin blown off by the high-speed gas exceeds the amount of molten resin supplied, this may lead to various problems. For instance, the flow may occur intermittently or concentrate on part of the projections.

The limit flow rates of the molten resin vary depending on the diameter of the capillaries, the configuration of the tips of the capillaries, the viscosity of the molten resin, the flow rate of the high-speed gas, etc.

The viscosity of the molten resin is adjusted in such a manner that the flow of the molten resin is easily divided when the high-speed gas comes into contact therewith. The suitable viscosity varies depending on the diameter and tip configuration of the capillaries, the flow rate of the high-speed gas, etc. In general, however, a suitable viscosity is about 100 poise or lower.

A typical example which may be used as the gas in the present invention is air.

Figure 5A:
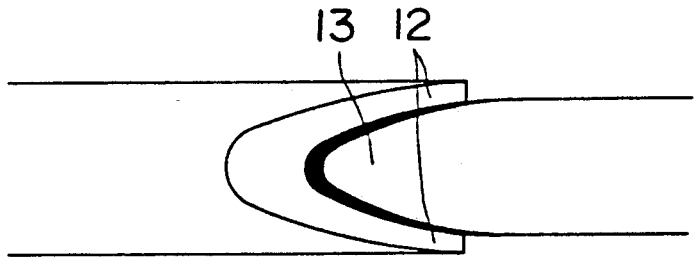
FIGS. 5A and 5B are a front view and a plan view, respectively, of the tip portion of a capillary, which are taken during spinning.
Figure 5B:
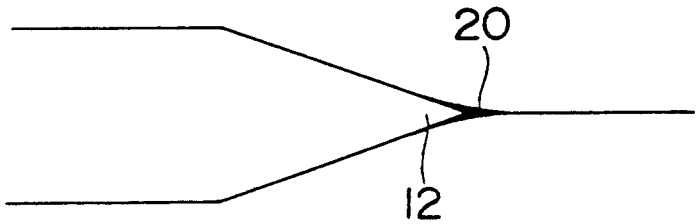
Figure 6:
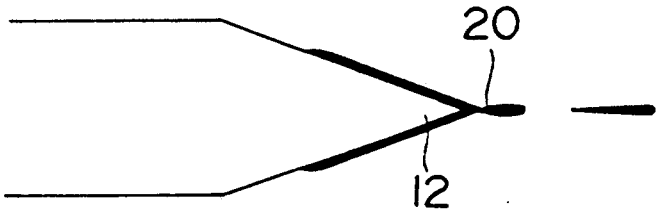
FIG. 6 is a plan view showing a condition in which a molten resin flows at an increased discharge rate.
Figure 7A:
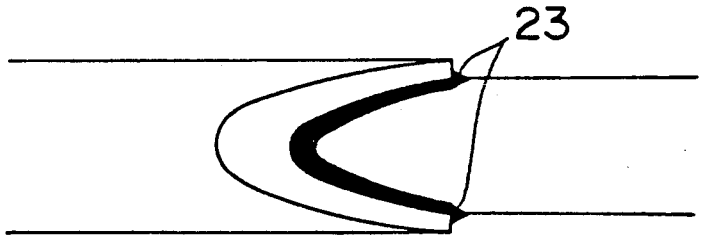
FIGS. 7A and 7B are a front view and a plan view, respectively, of the tip portion of a capillary having a configuration obtained by cutting off the pointed end portions of the projections.
Figure 7B:
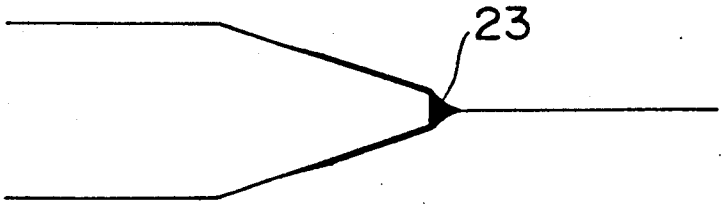

Operation:

When the high-speed gas blowing from the orifices provided in the periphery of the capillaries flows through the notches into the free ends of the capillaries, the flows of the molten resin are each divided. The resin flows following the projections formed by the notches till it reaches the tips of the projections, from which the resin is drawn into a fibrous form. FIGS. 5A and 5B show the example in which the capillary 11 has its tip portion V-shaped by forming taper cut portions therein. When the flow of a molten resin 20 from the tip of the capillary was closely observed, it was found that the flow separated at the recess 13 into upper and lower parts which followed the projections 12, and the resin flowed from the tips of the projections in a stringing manner.

If the diameter of the capillaries is increased and, hence, the discharge amount is correspondingly increased, the flow of the molten resin 20 tends to be interrupted and thus tends to occur intermittently. This problem can be overcome to a certain extent by cutting off the pointed end portions of the tips of the projections 12. Specifically, it has been found that when the discharge amount is large, the molten resin stays at the end faces formed by the cutting, and forms liquid pools, as denoted at 23 in FIGS. 7A and 7B. From these pools 23, the resin flows out in a stringing manner. The pools 23 of the resin were found to be very stable.

Figure 8A:
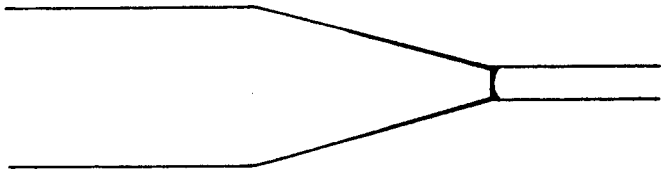
FIGS. 8A and 8B are front views of the tip portion of the capillary.
Figure 8B:
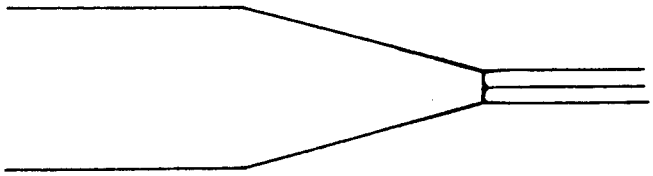

With regard to the configuration in which the tips of the projections 12 are cut, the following has also been found. That is, if the viscosity of the molten resin is low, the flow is further divided into a plurality of parts from the cut end-face, as shown in FIGS. 8A and 8B.

Figure 4A:
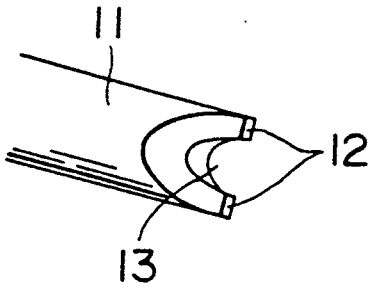
FIGS. 4A through 4G are perspective views of the tip portions of capillaries having different configurations.
Figure 4B:
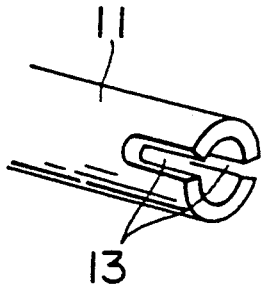
Figure 4C:
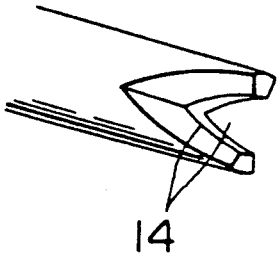
Figure 4D:
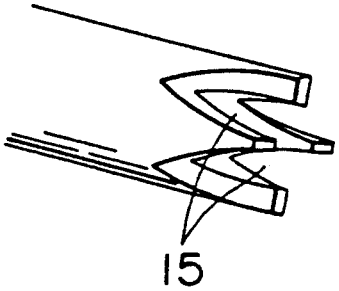
Figure 4E:
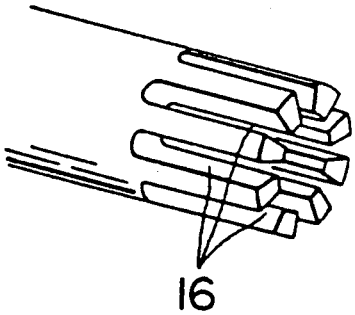
Figure 4F:
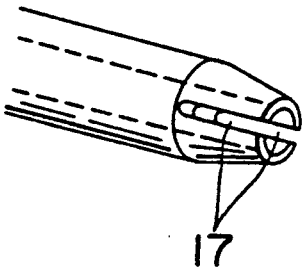
Figure 4G:
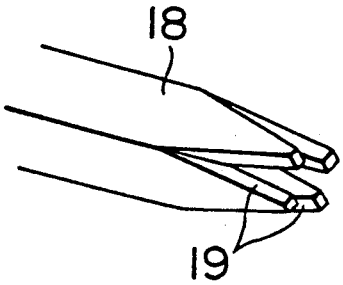
Figure 9:
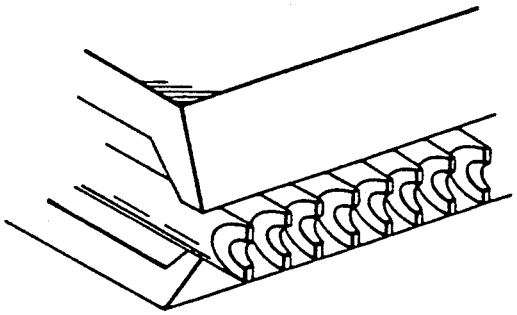
FIG. 9 is a perspective view of essential parts of a die in accordance with the present invention.
Figure 10:
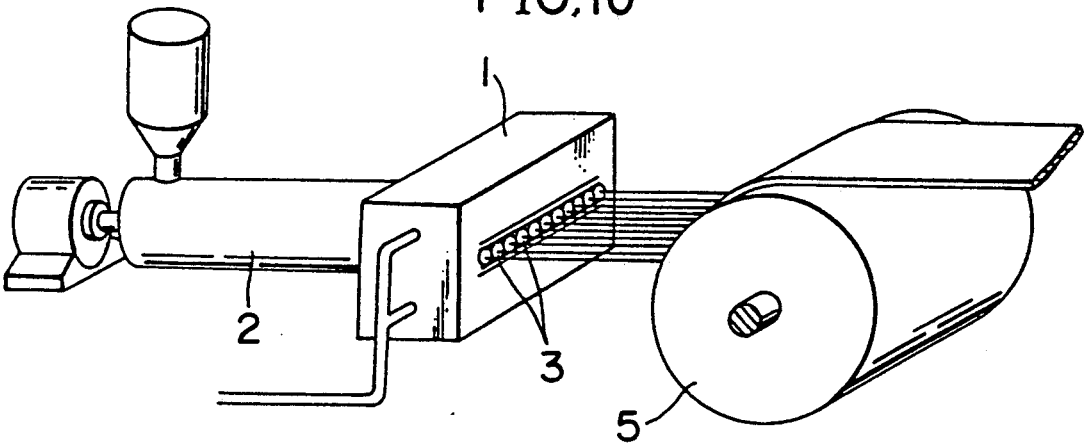
FIG. 10 is a perspective view of a spinning apparatus employing a melt-blowing method.

As described above, the flows of the molten resin are each divided by the high-speed gas blowing from the orifices and are guided by the projections, till the resin flows out from the tips of the projections. However, it is preferred that the projections of adjacent capillaries are not disposed in back-to-back contact with each other. If the projections are disposed in this manner, fibers flowing out may get entangled and tend to form ropes. For this reason, in the case where capillaries of the type shown in FIG. 4A are used, i.e., where the free ends are V-shaped by forming taper cut portions, the arrangement shown in Fig 9 is preferred in which the capillaries are each arranged with its projections aligned in the vertical direction, to an arrangement in which the projections of each capillary are aligned in the horizontal direction.

EXAMPLE 1

Figure 2:
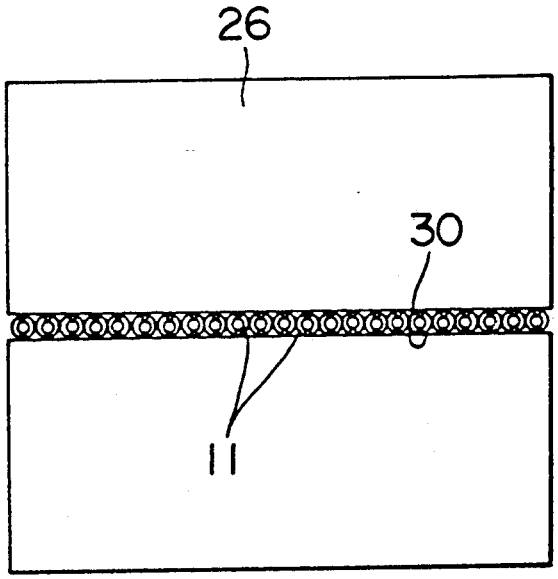
FIG. 2 is a side view of the melt-blowing die.
Figure 3:
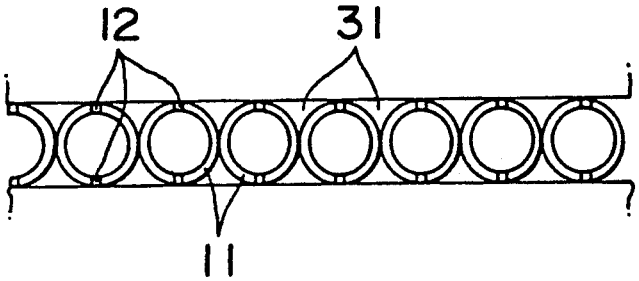
FIG. 3 is an enlarged view of essential parts shown in FIG. 2.

Conditions:

Polypropylene having a number-average molecular weight Mn of 38000, the ratio Mw/Mn of 3.0 (Mw being the weight-average molecular weight), and an intrinsic viscosity ($\eta$) of 1.1 was used as the thermoplastic resin. Nozzles were formed using capillaries with an outer diameter of 0.81 mm and an inner diameter of 0.51 mm, and the tips of the capillaries were machined into the configuration shown in FIGS. 7A and 7B. The angle at the tip of the V-shaped cuts was 30°, and the tips of the projections were cut in order to form flat portions having the dimensions of 0.2 mm (in the circumferential direction)×0.15 mm (in the radial direction). The above-described capillaries, serving as the capillaries 11 shown in FIGS. 1 to 3, were horizontally arranged in a melt-blowing die in a series, with the projections 12 of each capillary vertically aligned. While the capillaries were in this state, the other ends of the capillaries were held by a die block 25 from above and below and were thus firmly supported thereby. The free ends, or the ends with the machined tips, of the capillaries were held by lip portions 30 of gas plates 26 from above and below, with the tips projecting from the lip portions 30 by an amount of 1 mm. A forming operation was performed using this melt-blowing die. The polypropylene in its molten state was introduced into a chamber 27 of the die, and while the resin was extruded through the capillaries 11, a gas was introduced through an inlet port 28 into a gas chamber 29, and it was discharged from orifices 31 in the periphery of the capillaries 11. Air under a pressure of 4 kg/cm$^2$ and at a temperature of 280° C. was used as the drawing gas, and the resin was formed at its temperature of 280° C. and at a discharge amount of 0.22 gr per minute per hole.

Results:

A nonwoven fabric which was substantially free of any resin balls (shots) due to non-fibrous formation, or any thick ropes due to entanglement of fibers in their molten state, and which had very good hand feeling was obtained. During the formation of this nonwoven fabric, when the tips of the nozzles were examined through a microscope at a magnification of 40 times, the same condition as that shown in FIGS. 7A and 7B was observed. When the resultant nonwoven fabric was subjected to resin analysis, the number-average molecular weight was 33000, the ratio Mw/Mn was 2.4, and the intrinsic viscosity $\eta$ was 0.78. When a microphotograph of the nonwoven fabric was taken at a magnification of 500 times, and then an average fiber-diameter of twenty fibers was measured, it was found that the simple average fiber-diameter was 2.3 $\mu$m, and the square average fiber-diameter was 2.6 $\mu$m.

EXAMPLE 2

Conditions:

A forming operation was performed under the same conditions as those in Example 1, except that all the capillaries were arranged with the projections being inclined by an angle of 45° toward the same side.

Results:

Although the number of shots occurred slightly increased as compared with Example 1, a nonwoven fabric which had substantially no ropes and had very good hand feeling was obtained. During the formation of this nonwoven fabric, when the tips of the nozzles were examined through a microscope at a magnification of 40 times, the same condition as that shown in FIGS. 7A and 7B was observed. When the average fiber-diameter was measured in the same manner as in Example 1, it was found that the simple average fiber-diameter was 2.3 $\mu$m, and the square average fiber-diameter was 2.6 $\mu$m.

COMPARISON EXAMPLE

Conditions:

A forming operation was performed under the same conditions as those in Example 1, except that all the capillaries were horizontally arranged in such a manner that all the projections were disposed in back-to-back contact.

Results:

The numbers of shots and ropes occurred increased to a great extent, resulting in the formation of a nonwoven fabric having coarse hand feeling. During the formation this nonwoven fabric, when the tips of the nozzles were examined through a microscope at a magnification of 40 times, it was observed that although a pair formed by projections in back-to-back mutual contact allowed the formation of one resin flow, many of these pairs encountered, for instance, intermittent formation of liquid pools, such as those 23 shown in FIG. 7B.

EXAMPLE 3

Conditions:

A forming operation was performed under the same conditions as those in Example 1, except that air at a temperature of 320° C. was used while the resin temperature used was 320° C. and the resin discharge amount used was 0.40 gr per minute per hole.

Results:

A nonwoven fabric which had substantially no shots nor ropes and which had very good hand feeling was obtained. During the formation of this nonwoven fabric, when the tips of the nozzles were examined through a microscope at a magnification of 40 times, the same condition as that shown in FIG. 8A was observed in some of the nozzles, while the same condition as that shown in FIG. 8B was observed in others. When the resultant nonwoven fabric was subjected to resin analysis, the number-average molecular weight was 31000, the ratio Mw/Mn was 2.2, and the intrinsic viscosity $\eta$ was 0.71. When the average fiber-diameter was measured in the same manner as in Example 1, it was found that the simple average fiber-diameter was 2.1 $\mu$m, and the square average fiber-diameter was 2.3 $\mu$m. When this result is compared with Example 1, in spite of the fact that the discharge amount was approximately doubled, the fiber-diameter was decreased Thus, it has been confirmed that if the viscosity of the resin is lowered, the flow of the resin is redivided at the tips of the projections.

EXAMPLE 4

Conditions:

A forming operation was performed under the same conditions as those in Example 1, except that the capillaries were used while their tips remained pointed, that is, without cutting off their pointed end portions.

Results:

A nonwoven fabric which had only a small number of shots or ropes and which had good hand feeling was obtained. During the formation of this nonwoven fabric, when the tips of the nozzles were examined through a microscope at a magnification of 40 times, it was observed that the flow of the resin was divided in the same manner as that shown in FIGS. 5A and 5B at the tips of the projections.

EXAMPLE 5

Conditions:

A forming operation was performed under the same conditions as those in Example 3, except that capillaries of the same type as that used in Example 4, that is, capillaries having their tips remaining pointed, were used.

Results:

Although the number of shots occurred slightly increased as compared with Example 4, a nonwoven fabric which had substantially no ropes and had good hand feeling was obtained. During the formation of this nonwoven fabric, when the tips of the nozzles were examined through a microscope at a magnification of 40 times, it was observed that, in some of the projections, the resin flowed intermittently in the same manner as that shown in FIG. 6, and formed shots, though the number of these projections was small.

EXAMPLE 6

Conditions:

Polypropylene having a number-average molecular weight Mn of 38000, the ratio Mw/Mn of 3.0, and an intrinsic viscosity ($\eta$) of 1.1 was used as the thermoplastic resin. Nozzles were formed using capillaries with an outer diameter of 1.06 mm and an inner diameter of 0.7 mm. The tips of the capillaries were each formed with four V-shaped notches having a length of 1.3 mm in the axial direction, these notches being the same as those shown in FIG. 4D. Further, the tips of the four projections were cut in order to form flat portions having the dimensions of 0.2 mm (in the circumferential direction)$\times$0.18 mm (in the radial direction). These capillaries were arranged in such a manner that the four projections of each capillary were positioned like a letter X, and the projections of adjacent capillaries were kept from coming into back-to-back contact with each other. While the capillaries were in this state, the capillaries were partially held between the upper and lower lip portions, with the tips projecting from the lip portions by an amount of 1.5 mm. Air under a pressure of 4 kg/cm$^2$ and at a temperature of 350° C. was used as the drawing gas, and the resin was formed at its temperature of 350° C. and at a discharge amount of 1.26 gr per minute per hole.

Results:

A nonwoven fabric which had only a small number of shots or ropes and which had good hand feeling was obtained. During the formation of this nonwoven fabric, when the tips of the nozzles were examined through a microscope at a magnification of 40 times, the same conditions as those shown in FIGS. 8A and 8B were observed, in which the flow of the resin was redivided into a plurality of parts at the tip of each projection. When the resultant nonwoven fabric was subjected to resin analysis, the number-average molecular weight was 27000, the ratio Mw/Mn was 2.0, and the intrinsic viscosity $\eta$ was 0.58. When a microphotograph of the nonwoven fabric was taken at a magnification of 500 times, and an average fiber-diameter of twenty fibers was measured, it was found that the simple average fiber-diameter was 1.6 $\mu$m, and the square average fiber-diameter was 1.8 $\mu$m.

EXAMPLE 7

Conditions:

A forming operation was performed under the same conditions as those in Example 6, except that the number of V-shaped notches formed was increased to six.

Results:

A nonwoven fabric having good hand feeling was obtained although the fabric had a small number of shots or ropes. During the formation of this nonwoven fabric, when the tips of the nozzles were examined through a microscope at a magnification of 40 times, it was observed that, similar to the case of Example 6, the flow of the resin was redivided into a plurality of parts at the tip of each projection.

EXAMPLE 8

Conditions:

A die was produced using the same conditions as those in Example 6, except that the tips of the projections of the capillaries used were not cut and thus remained pointed. Polypropylene, which was the same type as that used in Example 6 was used, and a forming operation was performed under the following conditions: the resin temperature of 330° C.; the resin discharge amount of 0.57 gr per minute per hole; the drawing air pressure of 4 kg/cm$^2$; and the drawing air temperature of 330° C.

Results:

A nonwoven fabric which had only a small number of shots or ropes and which had good hand feeling was obtained. During the formation of this nonwoven fabric, when the tips of the nozzles were examined through a microscope at a magnification of 40 times, it was observed that one resin flow was formed at the tip of each projection, in the same manner as that shown in FIGS. 5A and 5B. When the resultant nonwoven fabric was subjected to resin analysis, the number-average molecular weight was 27000, the ratio Mw/Mn was 2.1, and the intrinsic viscosity $\eta$ was 0.61. When the average fiber-diameter was measured in the same manner as in Example 6, it was found that the simple average fiber-diameter was 2.0 $\mu$m, and the square average fiber-diameter was 2.1 $\mu$m. When this result is compared with Example 6, in spite of the fact that the discharge amount was decreased, the fiber-diameter was increased, conversely. Thus, it was deduced that no redivision of the resin had occurred at the tips of the projections.

COMPARISON EXAMPLE

Conditions:

A forming operation was performed under the same conditions as those in Example 1, except the following. Capillaries having the same inner and outer diameters as those of the capillaries used in Example 1 were used. However, the tip portions of the capillaries were formed into a conical configuration with an angle of 20° (i.e., the same configuration as that shown in FIG. 4F except that no notch grooves were formed in Example). These capillaries were arranged in the same manner as that shown in FIG. 9, with part of the capillaries being held between the upper and lower lip portions and with the tip portions projecting from the lip portions by an amount of 1.5 mm.

Results:

A nonwoven fabric which had only a small number of shots or ropes and which had good hand feeling was obtained. During the formation of this nonwoven fabric, when the tips of the nozzles were examined through a microscope at a magnification of 40 times, it was observed that one resin flow was formed from one hole. When the average fiber-diameter was measured in the same manner as in Example 1, it was found that the simple average fiber-diameter was 3.2 μm, and the square average fiber-diameter was 3.5 μm. When this result is compared with Example 1, in spite of the fact that the discharge amount was the same as that in Example 1, the fiber-diameter was increased. Thus, it was deduced that no redivision of the resin had occurred at the tips of the nozzles.

The present invention having the above-described arrangements provides the following effect.

According to the method and the die of the present invention, since a plurality of divided flows of the molten resin can be formed from one capillary, it is possible to increase the discharge amount of the molten resin without involving any increase in the fiber-diameter. In this way, it is possible to enhance the productivity.

According to the die of the present invention, a melt blowing die having an even clearance can be attained easily and positively. In addition, even when such factors as machining errors, thermal strain, or time-passage strains have more or less brought the holding surfaces into a condition in which they are not flat, it is possible to maintain the orifices substantially even, so far as the holding surfaces are kept in contact with the capillaries. Further, since the other ends of the capillaries are firmly supported, it is possible to eliminate any vibration of the capillaries during the discharge of a gas, or any irregularities of the outlets of the capillaries. In addition, it is possible to reduce the flow of gas that does not contribute to drawing, thereby enabling an increase in the drawing efficiency with respect to the gas.

In the die of the present invention, if the tips of the capillaries are slightly projected from the lip portions, the monitoring of the tips of the capillaries is facilitated, thereby enabling an abnormality to be found at an early stage.

Further, if notches are formed in each of the capillaries at constant intervals, fibers of like thicknesses can be obtained.

If notches are formed in each capillary at varied intervals, fibers of unlike thicknesses can be obtained.

Even if each of projections formed by the notches tapers, the following effects are achieved by providing the projection with a flat-headed configuration which corresponds to a configuration obtainable by cutting a pointed end portion of the projection. That is, even when a large discharge amount of the molten resin is used, it is possible to reduce the possibility that the flow of the resin may be interrupted midway and thus become intermittent. Further, the above-described arrangement enables the flow of the molten resin to be redivided into a plurality of parts.

If the capillaries are arranged in a series in such a manner that the projections of adjacent capillaries do not contact each other, this also contributes to the prevention of ropes which may be formed by entangled fibers.

What is claimed is:

1. A spinning method employing a melt-blowing method in which a thermoplastic resin is extruded through capillaries while the resin is in its molten state, and the resin is simultaneously drawn into a fibrous form by the use of a high-speed gas blowing from orifices provided in the periphery of the capillaries, said spinning method comprising: the step of preparing notches formed in the tip portions of said capillaries, so that, during spinning, said high-speed gas blowing from said orifices is allowed to flow through said notches whereby the flow of said molten resin being extruded through each of said capillaries is divided into two parts or more.

2. A spinning method employing a melt-blowing method according to claim 1, wherein said notches are prepared by cutting two sides of the tip portion of each of said capillaries into tapers so that said tip portion of the capillary is generally V shaped, with two projections being formed at said tip portion of said capillary.

3. A spinning method employing a melt-blowing method according to claim 2, wherein said capillaries comprise a plurality of capillaries arranged in a direction in which the projections are not disposed in back-to-back contact, the tips of said capillaries being projected from said orifices.

4. A spinning method employing a melt-blowing method according to claim 1, wherein said notches are formed from the tip of each of said capillaries in the axial direction thereof, said notches allowing said high-speed gas blowing from said orifices to flow therethrough whereby the flow of said molten resin being extruded through each of said capillaries is divided into two parts or more.

* * * * *